US008490398B2

(12) United States Patent
Poyyapakkam et al.

(10) Patent No.: US 8,490,398 B2
(45) Date of Patent: Jul. 23, 2013

(54) PREMIXED BURNER FOR A GAS TURBINE COMBUSTOR

(75) Inventors: Madhavan Poyyapakkam, Rotkreuz (CH); Anton Winkler, Olching (DE); Khawar Syed, Oberrohrdorf (CH); Andrea Ciani, Zurich (CH)

(73) Assignee: Alstom Technology Ltd., Baden (CH)

( * ) Notice: Subject to any disclaimer, the term of this patent is extended or adjusted under 35 U.S.C. 154(b) by 0 days.

(21) Appl. No.: 13/465,965

(22) Filed: May 7, 2012

(65) Prior Publication Data

US 2012/0285172 A1 Nov. 15, 2012

Related U.S. Application Data

(63) Continuation of application No. PCT/EP2010/066535, filed on Oct. 29, 2010.

(30) Foreign Application Priority Data

Nov. 7, 2009 (CH) ..... 1890/09

(51) Int. Cl.
*F02C 7/22* (2006.01)

(52) U.S. Cl.
USPC ..... 60/737; 60/738; 60/740; 60/746; 60/748; 431/354; 431/350; 431/351

(58) Field of Classification Search
USPC ... 431/354, 8, 182.35, 351, 182, 350; 60/737, 60/738, 740, 746, 748
See application file for complete search history.

(56) References Cited

U.S. PATENT DOCUMENTS 580,360 A 4/1897 Bachy
2,478,851 A * 8/1949 Traupel ..... 60/39.17

(Continued)

FOREIGN PATENT DOCUMENTS

EP 0 473 371 A1 3/1992
EP 0 911 585 A1 4/1999

(Continued)

OTHER PUBLICATIONS

International Search Report (PCT/ISA/210) issued on Jan. 20, 2011, by the European Patent Office as the International Searching Authority for International Application No. PCT/EP2010/066535.

(Continued)

*Primary Examiner* — Phutthiwat Wongwian
*Assistant Examiner* — Steven Sutherland
(74) *Attorney, Agent, or Firm* — Buchanan Ingersoll & Rooney PC

(57) ABSTRACT

The disclosure relates to a burner for a single combustion chamber or first combustion chamber of a gas turbine, with an injection device for the introduction of at least one gaseous and/or liquid fuel into the burner, wherein the injection device has at least one body which is arranged in the burner with at least one nozzle for introducing the at least one fuel into the burner, wherein the at least one body is located in a first section of the burner with a first cross-sectional area at a leading edge of the at least one body with reference to a main flow direction prevailing in the burner, wherein downstream of said body a mixing zone is located with a second cross-sectional area, and at and/or downstream of said body the cross-sectional area is reduced, such that the first cross-sectional area is larger than the second cross-sectional area.

20 Claims, 5 Drawing Sheets

U.S. PATENT DOCUMENTS

| | | | | | |
|---|---|---|---|---|---|
| 2,944,388 | A | | 7/1960 | Bayer | |
| 3,373,567 | A | | 3/1968 | Palfreyman et al. | |
| 3,620,012 | A | | 11/1971 | Wilde | |
| 4,830,315 | A | | 5/1989 | Presz, Jr. et al. | |
| 4,887,425 | A | | 12/1989 | Vdoviak | |
| 4,932,861 | A | | 6/1990 | Keller et al. | |
| 5,203,796 | A | | 4/1993 | Washam et al. | |
| 5,235,813 | A | | 8/1993 | McVey et al. | |
| 5,251,447 | A | * | 10/1993 | Joshi et al. | 60/737 |
| 5,297,391 | A | | 3/1994 | Roche | |
| 5,315,815 | A | | 5/1994 | McVey et al. | |
| 5,351,477 | A | * | 10/1994 | Joshi et al. | 60/39.463 |
| 5,423,608 | A | | 6/1995 | Chyou et al. | |
| 5,431,018 | A | | 7/1995 | Keller et al. | |
| 5,433,596 | A | * | 7/1995 | Dobbeling et al. | 431/350 |
| 5,487,659 | A | | 1/1996 | Eroglu et al. | |
| 5,511,375 | A | | 4/1996 | Joshi et al. | |
| 5,513,982 | A | * | 5/1996 | Althaus et al. | 431/350 |
| 5,593,302 | A | | 1/1997 | Althaus et al. | |
| 5,622,054 | A | | 4/1997 | Tingle | |
| 5,626,017 | A | | 5/1997 | Sattelmayer | |
| 5,638,682 | A | | 6/1997 | Joshi et al. | |
| 5,647,200 | A | * | 7/1997 | Althaus | 60/39.17 |
| 5,735,126 | A | * | 4/1998 | Schulte-Werning | 60/732 |
| 5,794,449 | A | | 8/1998 | Razdan et al. | |
| 5,803,602 | A | | 9/1998 | Eroglu et al. | |
| 5,813,232 | A | | 9/1998 | Razdan et al. | |
| 5,865,024 | A | | 2/1999 | Kress et al. | |
| 5,941,064 | A | | 8/1999 | Chevalier et al. | |
| 6,082,111 | A | | 7/2000 | Stokes | |
| 6,112,516 | A | | 9/2000 | Beule et al. | |
| 6,263,660 | B1 | | 7/2001 | Lawlor | |
| 6,460,326 | B2 | * | 10/2002 | Bechtel et al. | 60/39.465 |
| 6,786,430 | B2 | | 9/2004 | Hayashi | |
| 6,795,192 | B2 | | 9/2004 | Dickopf et al. | |
| 8,047,001 | B2 | | 11/2011 | Beeck et al. | |
| 2002/0038542 | A1 | * | 4/2002 | Akama et al. | 60/283 |
| 2002/0187448 | A1 | | 12/2002 | Eroglu et al. | |
| 2003/0128364 | A1 | | 7/2003 | Dickopf et al. | |
| 2006/0016192 | A1 | | 1/2006 | Bunel et al. | |
| 2006/0230764 | A1 | | 10/2006 | Schmotolocha et al. | |
| 2007/0033945 | A1 | | 2/2007 | Goldmeer et al. | |
| 2007/0151250 | A1 | | 7/2007 | Haynes | |
| 2008/0078182 | A1 | * | 4/2008 | Evulet | 60/776 |
| 2009/0081048 | A1 | | 3/2009 | Beeck et al. | |
| 2010/0300109 | A1 | | 12/2010 | Carroni et al. | |

FOREIGN PATENT DOCUMENTS

| | | | |
|---|---|---|---|
| EP | 1 434 007 | A2 | 6/2004 |
| EP | 1 619 441 | A1 | 1/2006 |
| EP | 1 752 709 | A2 | 2/2007 |
| EP | 1 257 809 | B1 | 10/2007 |
| EP | 1 847 696 | A1 | 10/2007 |
| EP | 2 072 899 | A1 | 6/2009 |
| GB | 2 216 999 | A1 | 10/1989 |
| GB | 2 293 001 | A | 3/1996 |
| JP | 54-121425 | A | 9/1979 |
| WO | WO 00/19081 | A2 | 4/2000 |
| WO | 2009019113 | A2 | 2/2009 |

OTHER PUBLICATIONS

Written Opinion (PCT/ISA/237) issued on Jan. 20, 2011, by the European Patent Office as the International Searching Authority for International Application No. PCT/ EP2010/066535.

Swiss Search Report issued on Apr. 6, 2010 for Swiss Application No. 1890/2009.

International Search Report (PCT/ISA/210) issued on Jul. 14, 2011, by the European Patent Office as the International Searching Authority for International Application No. PCT/EP2010/066497.

Written Opinion (PCT/ISA/237) issued on Jul. 14, 2011, by the European Patent Office as the International Searching Authority for International Application No. PCT/EP2010/066497.

Swiss Search Report issued on May 12, 2010 for Swiss Application No. 1887/2009.

International Search Report (PCT/ISA/210) issued on Jun. 4, 2011, by the European Patent Office as the International Searching Authority for International Application No. PCT/EP2010/066513.

Written Opinion (PCT/ISA/237) issued on Jun. 4, 2011, by the European Patent Office as the International Searching Authority for International Application No. PCT/ EP2010/066513.

Swiss Search Report issued on May 12, 2010 for Swiss Application No. 1888/2009.

International Search Report (PCT/ISA/210) issued on Jul. 14, 2011, by the European Patent Office as the International Searching Authority for International Application No. PCT/EP2010/066395.

Written Opinion (PCT/ISA/237) issued on Jul. 14, 2011, by the European Patent Office as the International Searching Authority for International Application No. PCT/ EP2010/066395.

Swiss Search Report issued on May 12, 2010 for Swiss Application No. 1886/2009.

International Search Report (PCT/ISA/210) issued on Jan. 20, 2011, by the European Patent Office as the International Searching Authority for International Application No. PCT/EP2010/066522.

Written Opinion (PCT/ISA/237) issued on Jul. 14, 2011, by the European Patent Office as the International Searching Authority for International Application No. PCT/EP2010/066522.

Swiss Search Report issued on Apr. 7, 2010 for Swiss Application No. 1889/2009.

Cumpsty, "Jet Propulsion: A Simple Guide to the Aerodynamic and Thermodynamic Design and Performance of Jet Engines", 2003 2nd Ed. Cambridge University Press, p. 229.

Morris, "Analyses for Turbojet Thrust Augmentation with Fuel-Rich Afterburning of Hydrogen, Dibroane, and Hydrazine", National Advsiory Committee for Aeronautics, 1957, p. 1.

Lundin, "Summary of NACA Research on Afterburners for Turbojet Engines", 1956, p. 20.

* cited by examiner f)

g)

PREMIXED BURNER FOR A GAS TURBINE COMBUSTOR

RELATED APPLICATION(S)

This application claims priority as a continuation application under 35 U.S.C. §120 to PCT/EP2010/066535, which was filed as an International Application on Oct. 29, 2010 designating the U.S., and which claims priority to Swiss Application 01890/09 filed in Switzerland on Nov. 7, 2009. The entire contents of these applications are hereby incorporated by reference in their entireties.

FIELD

A burner is disclosed for a first of a sequential combustion chamber of a gas turbine or a single combustor only, with an injection device for the introduction of at least one gaseous and/or liquid fuel into the burner.

BACKGROUND INFORMATION

In order to achieve a high efficiency, a high turbine inlet temperature is used in standard gas turbines. As a result, there arise high NOx emission levels and higher life cycle costs. This can be mitigated with a sequential combustion cycle, wherein the compressor delivers nearly double the pressure ratio of a known one. The main flow passes the first combustion chamber (e.g. using a burner of the general type as disclosed in EP 1 257 809 or as in U.S. Pat. No. 4,932,861, also called EV combustor, where the EV stands for environmental), wherein a part of the fuel is combusted. After expanding at the high-pressure turbine stage, the remaining fuel is added and combusted (e.g. using a burner of the type as disclosed in U.S. Pat. Nos. 5,431,018 or 5,626,017 or in U.S. Patent Application Publication No. 2002/0187448, also called a SEV combustor, where the S stands for sequential). Both combustors contain premixing burners, as low NOx emissions involve high mixing quality of the fuel and the oxidizer.

SEV-burners can be designed for operation on natural gas and oil only. The subsequent mixing of the fuel and the oxidizer at the exit of the mixing zone can be just sufficient to allow low NOx emissions (mixing quality), to avoid thermo-acoustic pulsations and to avoid flashback (residence time).

SUMMARY

A burner is disclosed for a single combustion chamber or first combustion chamber of a gas turbine, comprising: an injection device for introducing at least one gaseous and/or liquid fuel into the burner, wherein the injection device includes, at least one body located in a first section of the burner with a first cross-sectional area at a leading edge of the at least one body with reference to a main flow direction prevailing in the burner arranged in the burner, at least one nozzle for introducing the at least one fuel into the burner, and a mixing zone located downstream of the body with a second cross-sectional area, at and/or downstream of the body the cross-sectional area is reduced, such that the first cross-sectional area is larger than the second cross-sectional area.

BRIEF DESCRIPTION OF THE DRAWINGS

Exemplary embodiments of the disclosure are described in the following with reference to the drawings, which are for the purpose of illustrating the exemplary embodiments of the disclosure and not for the purpose of limiting the same. In the drawings.

DETAILED DESCRIPTION

Figure 1:
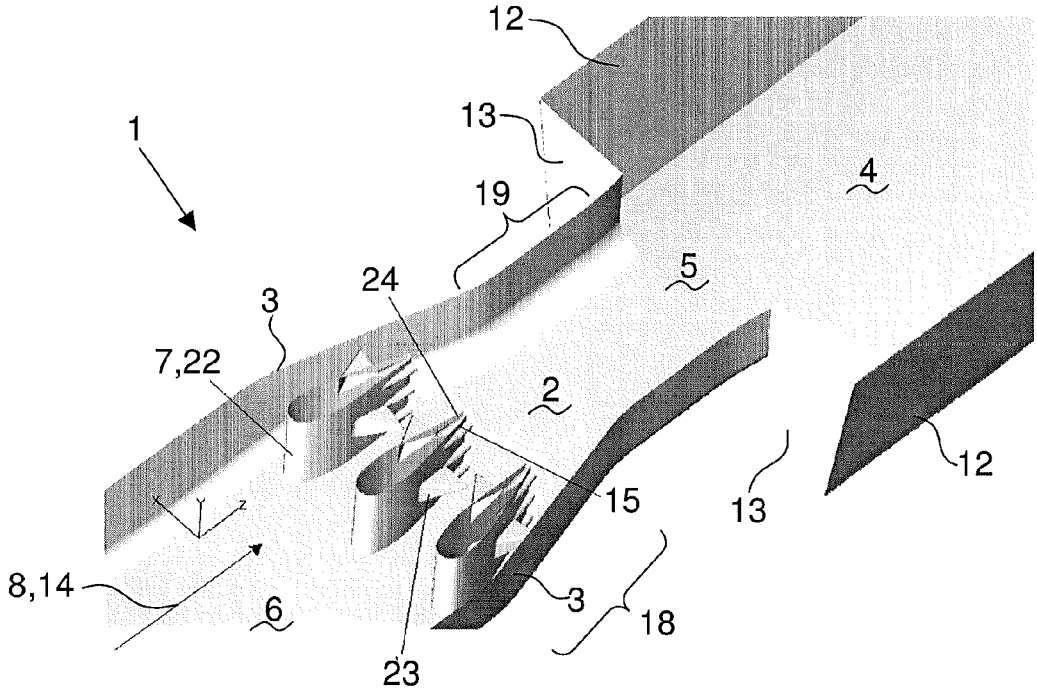
FIG. 1 shows an exemplary embodiment of the burner according to the disclosure in a perspective view.

Exemplary embodiments of the present disclosure provide a premixed burner, for example, applicable to a 1st stage combustor in a 2-stage combustion system or to a single combustion burner system. The exemplary embodiments can provide rapid mixing achievable, for example, for highly reactive fuels with acceptable burner pressure drops. Exemplary embodiments of the disclosure can provide rapid fuel-air mixing occurring in short burner-mixing lengths. The burner can be usable, for example, but not exclusively for high reactivity conditions, i.e., for a situation where high reactivity fuels, specifically MBtu fuels, shall be burned in such a burner.

Exemplary embodiments of the disclosure relate to a burner for a single combustion chamber or first combustion chamber of, for example, a gas turbine, with an injection device for the introduction of at least one gaseous and/or liquid fuel into the burner. The injection device has at least one body which is arranged in the burner with at least one nozzle for introducing the at least one fuel into the burner. The at least one body is located in a first section of the burner with a first cross-sectional area at a leading edge of the at least one body with reference to a main flow direction prevailing in the burner. Downstream of the body, a mixing zone is located with a second cross-sectional area.

According to an exemplary embodiment of the disclosure, at and/or downstream of the body, the cross-sectional area is reduced, such that the first cross-sectional area is larger than the second cross-sectional area. In other words the cross-section available for the flow of combustion gases at the leading edge of the at least one body is larger than the cross-section available for the flow of combustion gases in the mixing zone. This reduction of the cross-section can lead to an increase of the flow velocity along this flow path.

Exemplary embodiments of the disclosure can be applied in the context of annular combustors but also in the context of can-annular combustors wherein individual burner cans feed hot combustion gas into respective individual portions of an arc of the turbine inlet vanes. Each can include a plurality of main burners disposed in a ring around a central pilot burner, as for example in U.S. Pat. No. 6,082,111 or EP 1434007.

Exemplary embodiments of the disclosure can include aerodynamically facilitated axial fuel injection with mixing enhancement via small sized vortex generators. As a result, the premixed burner can operate for increased fuel flexibility without suffering on high NOx emissions or flashback. The proposed burner configuration is applicable for both annular and can-annular combustors. Flame stabilization can be achieved by pushing the vortex breakdown occurrence to the burner exit. The burner velocities, the axial pressure gradient, the dimensions of the bodies and optionally arranged vortex generators can be varied to control the vortex breakdown to occur near the burner exit.

The possible range of applications of the exemplary embodiments of the burner is broad. The burner can be used for gas turbines, for boilers, water heaters, etc. It can be implemented in can-annular, or annular combustors, and it can be operated with multiple or single fuel, or a different variety of fuels (natural gas, H2, Oil, LBTU fuels etc.)

Advantages of the exemplary embodiments thereof can be summarized as follows:

Higher burner velocities (i.e. lower residence times) which also allow to accommodate highly reactive fuels;

Lower burner pressure drop for achieving desired fuel air mixing performance;

Small scale mixing achieved with flute/vortex generator injectors rely less on the large scale vortex structures; and Flame stabilization at the burner exit can be achieved by controlling or delaying the vortex breakdown through modifying the burner axial pressure gradient.

According to a first exemplary embodiment of the burner, the second cross-sectional area is at least 10%, (for example, at least 20%, at least 30%, and at least 40%) smaller than the first cross-sectional area. By having such a reduced cross-section, the main flow velocity can be increased making it possible to use high reactivity fuels or to apply high inlet temperatures as the residence time in the mixing section can be reduced.

According to an exemplary embodiment, in the first section the flow cross-sectional area of the burner can be continuously reducing, so in the section where the bodies are arranged, the cross-sectional area is continuously reducing.

The body can have a longitudinal extension substantially along the main flow direction, and the flow cross-sectional area of the burner can be continuously reducing from the first cross-sectional area at least over a length of the longitudinal extension, for example, over 1½ or twice the length of this longitudinal extension.

Injection can be cross-flow but also can be in-line, so the injection angle can be lower than 90°. The injection device can inject fuel under this angle lower than 90° with respect to the main flow direction of the air flow. The system according to exemplary embodiment of the disclosure can be suitable for in-line fuel injection. So according to an exemplary embodiment, the injection device can inject fuel substantially along the main flow direction. This can allow higher reactivity conditions as the fuel is carried downstream rapidly and it in addition allows the use of low pressure carrier gas.

Fuel can thus be injected under a substantially zero angle with respect to the main flow direction of the air flow (full in-line injection). However, it can also be injected at a slight inclination with respect to the main flow direction, so, for example, at an angle thereto of less than 30°, for example, less than 15°.

In an exemplary embodiment of the disclosure, a so-called lance type injection device can be used. In this case the at least one body can be configured as a streamlined body which has a streamlined cross-sectional profile and which can extend with a longitudinal direction perpendicularly to, or at an inclination to, a main flow direction prevailing in the burner. The at least one nozzle can have its outlet orifice at or in a trailing edge of the streamlined body. The body can have two lateral surfaces (for example, at least for one central body substantially parallel to the main flow direction and converging, i.e., inclined for the others). In an exemplary embodiment according to the disclosure, upstream of the at least one nozzle on at least one lateral surface there can be located at least one vortex generator.

According to the exemplary embodiments of the disclosure, the vortex generator and the fuel injection device can be merged into one single combined vortex generation and fuel injection device. By doing this, mixing of fuels with oxidation air and vortex generation can take place in very close spatial vicinity and relatively efficiently, such that rapid mixing is possible and the length of the mixing zone can be reduced. It is even possible in an exemplary embodiment of the disclosure, by corresponding design and orientation of the body in the oxidizing air path, to omit flow conditioning elements as the body can also take over the flow conditioning. All this can be possible without severe pressure drop along the injection device such that the overall efficiency of the process can be maintained.

In one burner according to an exemplary embodiment of the disclosure, at least one such injection device can be located in the first section, for example, at least two such injection devices can be located within one burner, for example, three such injection devices or flutes can be located within one burner. In case of three flutes, a central one can be arranged substantially parallel to the main flow of oxidizing medium, while the lateral ones can be arranged in a converging manner, substantially parallel to sidewalls converging towards the mixing section.

In order to have a sufficiently efficient vortex generation to produce higher circulation rates at a minimum pressure drop, the vortex generator can have an attack angle in the range of 15-40° (for example, in the range of 15-20°) and/or a sweep angle in the range of 40-70° (for example, in the range of 55-65°).

In an exemplary embodiment according to the disclosure, vortex generators as they are disclosed in U.S. Pat. No. 5,803,602 as well as in U.S. Pat. No. 5,423,608, can be used in the present context, the disclosure of these two documents being specifically incorporated into this disclosure by reference.

At least two nozzles (for example, at least four, or six) can be arranged at different positions along the trailing edge (in a row with spacings in between), wherein upstream of each of these nozzles at least one vortex generator is located.

In an exemplary embodiment of the disclosure, two vortex generators can be located on opposite sides of the body for one nozzle or for a pair of nozzles.

"Upstream" in the context of the vortex generators relative to the nozzles can mean that the vortex generator generates a vortex at the position of the nozzle.

In an exemplary embodiment of the disclosure, the vortex generators can also be upstream facing in order to bring the vortices closer to the fuel injection location.

Vortex generators to adjacent nozzles (along the row) can be located at opposite lateral surfaces of the body. More than three (for example, at least four) nozzles can be arranged along the trailing edge and vortex generators can be alternatingly located at the two lateral surfaces.

In an exemplary embodiment of the disclosure, downstream of each vortex generator there can be located at least two nozzles for fuel injection at the trailing edge.

In an exemplary embodiment of the disclosure, the streamlined body can extend across the entire flow cross section between opposite walls of the burner. These opposite walls between which the streamlined bodies extend can be parallel, while the sidewalls joining these two parallel walls can converge towards the mixing section. It is however also possible that these opposite walls converge as well, in this case in a side view, the streamlined body can have a trapezoidal shape.

The profile of the streamlined body can be parallel to the main flow direction. It can however also be inclined with respect to the main flow direction at least over a certain part of its longitudinal extension wherein, for example, the profile of the streamlined body can be rotated or twisted, for example, in opposing directions relative to the longitudinal axis on both sides of a longitudinal midpoint, in order to impose a swirl on the main flow.

In an exemplary embodiment of the disclosure, the vortex generator(s) can be provided with cooling elements. These cooling elements can be effusion/film cooling holes provided in at least one of the surfaces of the vortex generator. Also possible is internal cooling such as impingement cooling. The film cooling holes can be fed with air from carrier gas feed also used for the fuel injection to simplify the setup. Due to the in-line injection of the fuel, lower pressure carrier gas can be used, so the same gas supply can be used for fuel injection and cooling.

Also the body can be provided with cooling elements, wherein, for example, these cooling elements can be internal circulation of a cooling medium along the sidewalls of the body and/or by film cooling holes, for example, located near the trailing edge. Also possible is impingement cooling. The cooling elements can be fed with air from the carrier gas feed also used for the fuel injection.

As mentioned above, the fuel can be injected from the nozzle together with a carrier gas stream (the fuel can be injected centrally and a carrier gas circumferentially encloses the fuel jet), wherein the carrier gas air can be low pressure air with a pressure in the range of about 10-20 bar (±10%), for example, in the range of 16-20 bar (±10%). As in-line injection is used, a lower pressure can be used for the carrier gas.

The streamlined body can have a symmetric cross-sectional profile, i.e. one which is mirror symmetric with respect to the central plane of the body (while however this symmetry may not include necessarily also the vortex generators, these can also be mounted asymmetrically on such a symmetric profile).

The streamlined body can also be arranged centrally in the burner with respect to a width of a flow cross section.

The streamlined body can be arranged in the burner such that a straight line connecting the trailing edge to a leading edge extends parallel to the main flow direction of the burner.

A plurality of separate outlet orifices of a plurality of nozzles can be arranged next to one another and arranged at the trailing edge.

At least one slit-shaped outlet orifice can be, in the sense of a nozzle, arranged at the trailing edge.

Exemplary embodiments of the disclosure relate to the use of a burner as defined above for the combustion under high reactivity conditions, for example, for the combustion at high burner inlet temperatures and/or for the combustion of MBtu fuel, normally with a calorific value of 5000-20,000 kJ/kg (for example, 7000-17,000 kJ/kg, and 10,000-15,000 kJ/kg), and such a fuel including hydrogen gas.

Exemplary embodiments of the disclosure relate in, for example, (but not exclusively) to combustion of fuel air mixtures having lower ignition delay times and higher flame speeds. This can be achieved by an integrated approach, which can allow higher velocities of the main flow and in turn, a lower residence time of the fuel air mixture in the mixing zone. The challenge regarding the fuel injection is twofold with respect to the use of hydrogen rich fuels and fuel air mixtures:

Hydrogen rich fuels can change the penetration behavior of the fuel jets. The penetration can be determined by the cross section areas of the burner and the fuel injection holes, respectively.

The second is that depending on the type of fuel or the temperature of the fuel air mixture, the reactivity of the fuel air mixture can change.

Exemplary embodiments of the disclosure relate to the stabilized propagating flame regime of burners.

For each temperature and mixture composition, the laminar/turbulent flame speeds and the ignition delay time changes. As a result, hardware configurations should be provided offering a suitable operation window. For each hardware configuration, the upper limit regarding the fuel air reactivity can be given by the flashback safety.

In the framework of a H2 premixed burner, the flashback risk can be increased, as the residence time in the mixing zone exceeds the ignition delay time of the fuel air. Mitigation can be achieved in several ways:

The inclination angle of the fuel can be adjusted to decrease the residence time of the fuel.

The reactivity can be slowed down by diluting the fuel air mixture with nitrogen or steam, respectively.

The length of the mixing zone can be kept constant, if in turn the main flow velocity is increased. However, then normally a penalty on the pressure drop must be taken.

By implementing more rapid mixing of the fuel and the oxidizer, the length of the mixing zone can be reduced while maintaining the main flow velocity.

Exemplary embodiments of the disclosure can evolve an improved premixer configuration, wherein the latter two points are addressed.

In order to allow capability for highly reactive fuels, the injector can be arranged to perform flow conditioning, injection and mixing flame stabilization simultaneously. As a result, the injector can save burner pressure loss, which is currently utilized in the various devices along the flow path. If the combination of flow conditioning device, vortex generators and injector is replaced by the proposed disclosure, the velocity of the main flow can be increased in order to achieve a short residence time of the fuel air mixture in the mixing zone.

FIG. 1 shows how in the burner according to an exemplary embodiment of the disclosure, the cross-sectional area is reduced to accommodate higher burner velocities in order to help in operating the burner safely for highly reactive fuels and operating conditions. The vortex break down location is controlled so as to provide flame stabilization in addition to sudden burner-liner expansion. The burner cross-sectional area can be varied in particular in section 18 to allow for gradual change in the axial pressure gradient in order to delay the vortex breakdown occurrence.

More specifically in FIG. 1, where the top wall of the burner has been removed, the main flow of oxidizing medium, for example, from the compressor, enters along arrow 8 at the inlet side 6 of the actual burner 1.

Within a converging portion 18, there can be located three injection devices 7, which in this case are structured as streamlined bodies 22. These are arranged within the flow path with substantially parallel longitudinal axes while only the central plane of the central streamlined body is substantially parallel to the flow direction 8 while the outer two streamlined bodies or fluids 22 are inclined with respect to the flow direction 8. For example, in the converging portion 18 of the burner, the burner walls 3 are converging and the central planes of the flutes 22 are located substantially parallel to these inclined walls. At the trailing edges 24 of these burners there are located nozzles 15, which inject fuel.

Downstream of this converging portion, the length of which can be longer than the lengths of the flutes 22, there follows a reduced burner cross sectional area 19. The actual mixing space or mixing zone 2 is therefore in this case formed by the portion of the converging portion 18 which is located downstream of the trailing edge 24 of the flutes 22, and by the reduced burner cross sectional area 19. In this area 19 the cross section of the flow path can be substantially constant. Downstream of this area 19 the flow expands at the transition 13 where the backside wall 13 of the combustion space or combustion chamber 4 is located. At this outlet side 5 or burner exit vortex break down takes place and it is at or just downstream of this where the flame is controlled to be located.

The combustion chamber 4 is bordered by the combustion chamber walls 12.

Figure 2:
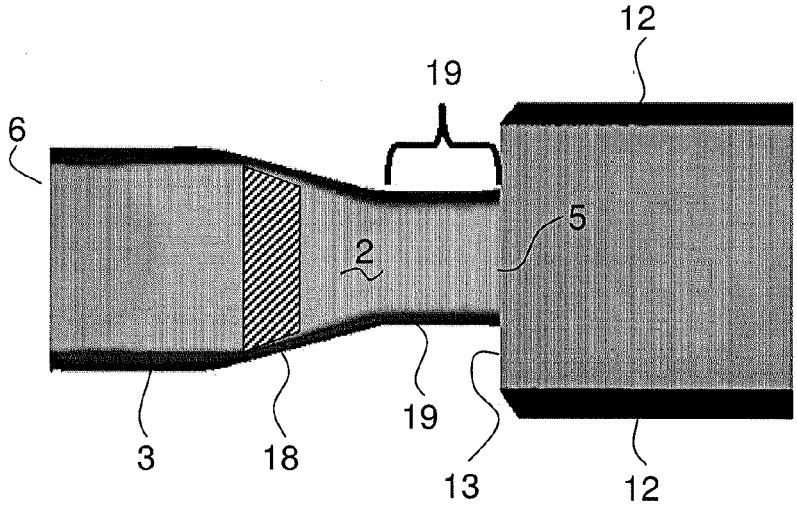
FIG. 2 shows such a primary burner with a reduced exit cross-section area in an axial cut.
Figure 3:
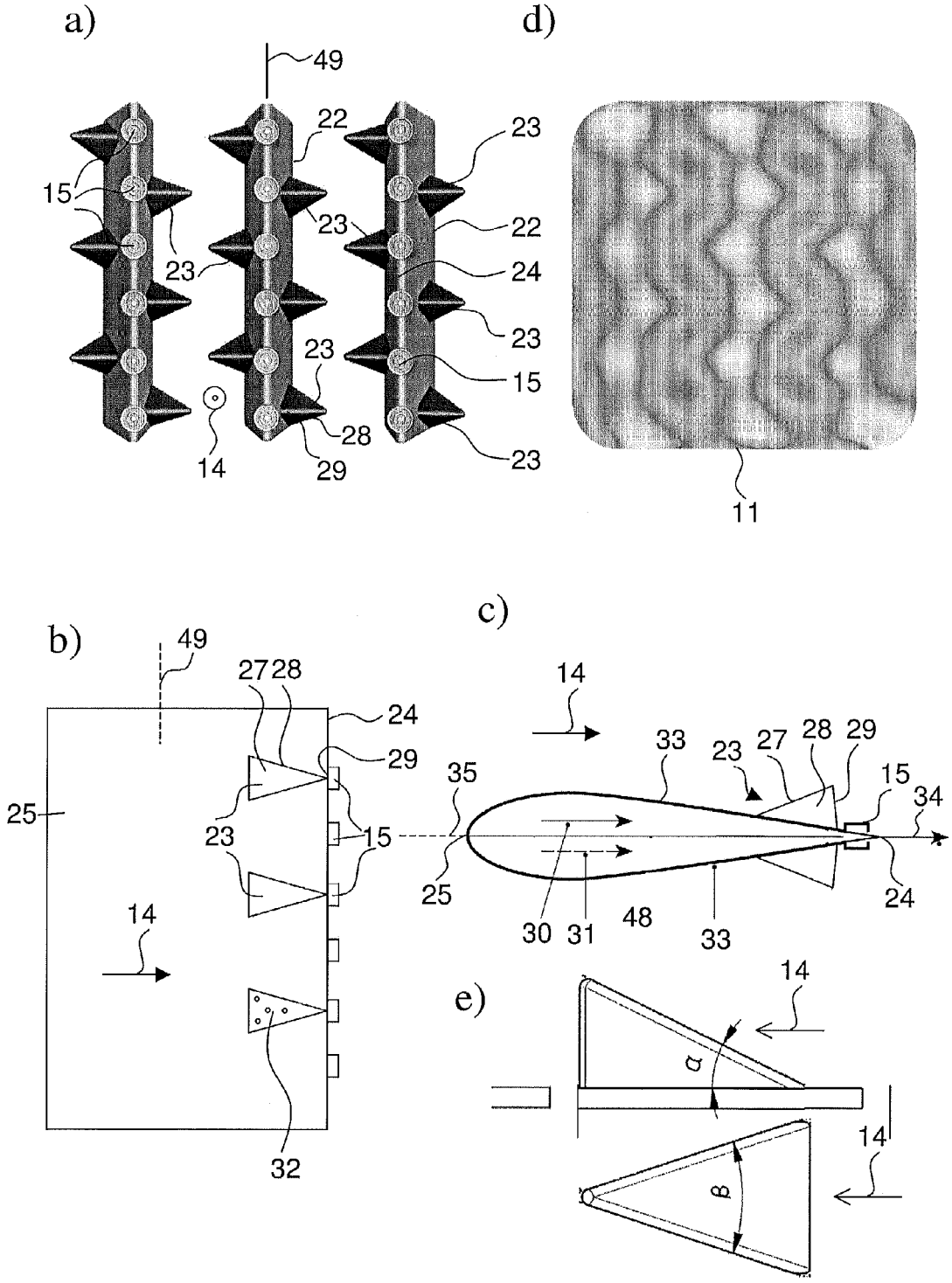
FIG. 3 shows in a) the streamlined body in a view opposite to the direction of a flow of oxidizing medium with fuel injection parallel to the flow of oxidizing medium, in b) a side view onto such a streamlined body, in c) a cut perpendicular to a central plane of the streamlined body in d) a corresponding fuel mast fraction contour at an exit of the burner, in e) a schematic sketch how an attack angle and a sweep angle of a vortex generator are defined, wherein in the upper representation a side elevation view is given, and in the lower representation a view onto the vortex generator in a direction perpendicular to a plane on which the vortex generator is mounted are given, in f) a perspective view onto a body and its interior structure, and in g) in a cut perpendicular to a longitudinal axis.
Figure 3:
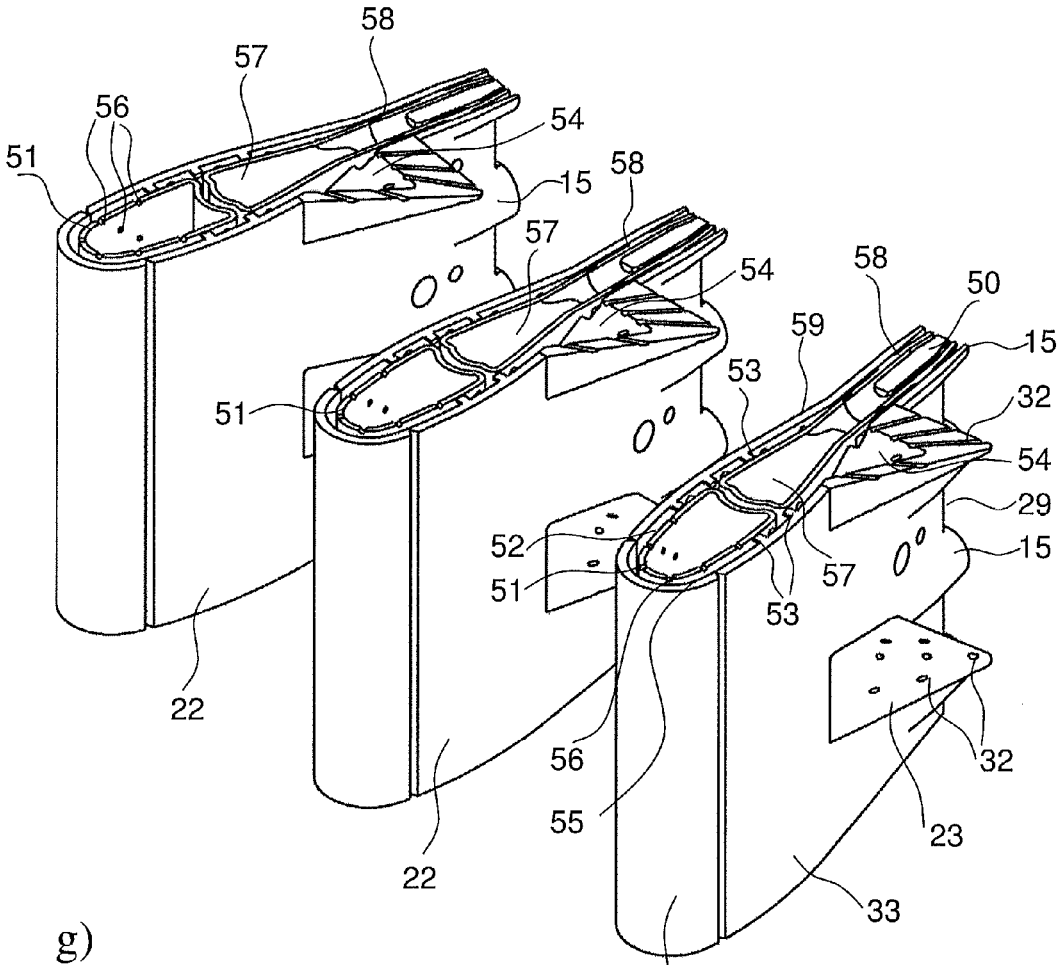
Figure 3:
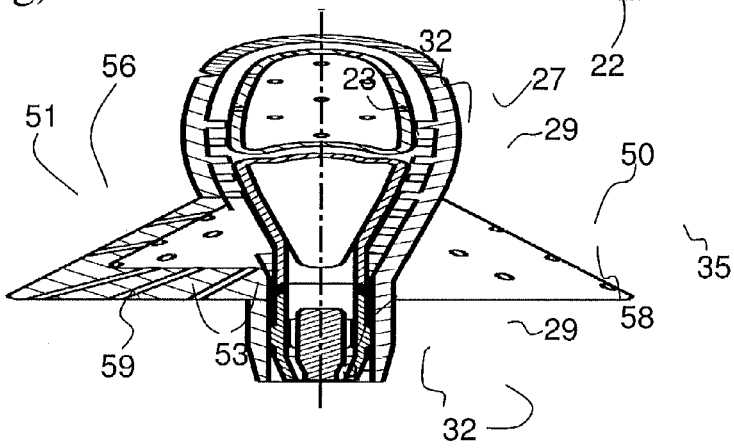

FIG. 2 shows a set-up, where the proposed burner area can be reduced considerably. The higher burner velocities help in operating the burner safely at highly reactive conditions. In FIG. 3, a proposed burner is shown with reduced exit cross-section area. In this case downstream of the inlet side 6 a fuel injection device according to an exemplary embodiment of the disclosure is located, which is given as a streamlined body 22 extending with its longitudinal direction across the two opposite walls 3 of the burner. At the position where the streamlined body 22 is located the two walls 3 converge in a converging portion 18 and narrow down to a reduced burner cross-sectional area 19. This defines the mixing space 2 which ends at the outlet side 5 where the mixture of fuel and air enters the combustion chamber or combustion space 4 which is delimited by walls 12.

Exemplary embodiments of the inline injection with flute/VG concept shall be presented below.

The first exemplary embodiment is to stagger the vortex generators 23 embedded on the bodies or flutes 22 as shown in FIG. 3. The vortex generators 23 are located sufficiently upstream of the fuel injection location to avoid flow recirculations. The vortex generator attack and sweep angles are chosen to produce highest circulation rates at a minimum pressure drop.

Such vortex generators have an attack angle $\alpha$ in the range of 15-20° and/or a sweep angle $\beta$ in the range of 55-65°, for a definition of these angles reference is made to FIG. 3*e*), where for an orientation of the vortex generator in the air flow 14 as given in FIG. 3*a*) the definition of the attack angle $\alpha$ is given in the upper representation which is an elevation view, and the definition of the sweep angle $\beta$ is given in the lower representation, which is a top view onto the vortex generator.

As illustrated the body 22 is defined by two lateral surfaces 33 joined in a smooth round transition at the leading edge 25 and ending at a small radius/sharp angle at the trailing edge 24 defining the cross-sectional profile 48. Upstream of trailing edge the vortex generators 23 are located. The vortex generators can be a triangular shape with a triangular lateral surface 27 converging with the lateral surface 33 upstream of the vortex generator, and two side surfaces 28 substantially perpendicular to a central plane 35 of the body 22. The two side's surfaces 28 converge at a trailing edge 29 of the vortex generator 23, and this trailing edge is typically just upstream of the corresponding nozzle 15.

The lateral surfaces 27 but also the side surfaces 28 can be provided with effusion/film cooling holes 32.

The whole body 22 is arranged between and bridging opposite the two walls 3 of the combustor, so along a longitudinal axis 49 substantially perpendicular to the walls 3. Parallel to this longitudinal axis there is, according to this embodiment, the leading edge 25 and the trailing edge 24. It is however also possible that the leading edge 25 and/or the trailing edge are not linear but are rounded.

At the trailing edge the nozzles 15 for fuel injection are located. In this case fuel injection takes place along the injection direction 35 which is parallel to the central plane 35 of the body 22. Fuel as well as carrier air are transported to the nozzles 15 as schematically illustrated by arrows 30 and 31, respectively. The fuel supply can be provided by a central tubing, while the carrier air is provided in a flow adjacent to the walls 33 to also provide internal cooling of the structures 22. The carrier airflow can also be used for supply of the cooling holes 23. Fuel can be injected by generating a central fuel jet along direction 34 enclosed circumferentially by a sleeve of carrier air.

The staggering of vortex generators 23 can help in avoiding merging of vortices resulting in preserving very high net longitudinal vorticity. The local conditioning of fuel air mixture with vortex generators close to respective fuel jets improves the mixing. The overall burner pressure drop is significantly lower for this concept. The respective vortex generators produce counter rotating vortices which at a specified location pick up the axially spreading fuel jet.

Three bodies 22 according to an exemplary embodiment arranged within an annular secondary combustion chamber are given in perspective view in FIG. 3*f*, wherein the bodies are cut perpendicularly to the longitudinal axis 49 to show their interior structure, and in a cut perpendicular to the longitudinal axis in FIG. 3*g*.

In the cavity formed by the outer wall 59 of each body on the trailing side thereof there is located the longitudinal inner fuel tubing 57. It is distanced from the outer wall 59, wherein this distance is maintained by distance keeping elements 53 provided on the inner surface of the outer wall 59.

From this inner fuel tubing 57 the branching off tubing extends towards the trailing edge 29 of the body 22. The outer walls 59 at the position of these branching off tubings is shaped such as to receive and enclose these branching off tubings forming the actual fuel nozzles with orifices located downstream of the trailing edge 29.

In the substantially cylindrically shaped interior of the branching off tubings there is located a cylindrical central element 50 which leads to an annular stream of fuel gas. As between the wall of the branching off tubings and the outer walls 59 at this position there is also an substantially annular interspace, this annular stream of fuel gas at the exit of the nozzle is enclosed by an substantially annular carrier gas stream.

Towards the leading edge of the body 22 in the cavity formed by the outer wall 59 of the body in this embodiment there is located a carrier air tubing channel 51 extending substantially parallel to the longitudinal inner fuel tubing channel 57. Between the two channels 57 and 51 there is an interspace 55. The walls of the carrier air tubing channel 51 facing the outer walls 59 of the body 22 run substantially parallel thereto again distanced therefrom by distancing elements 53. In the walls of the carrier air tubing channel 51 there are located cooling holes 56 through which carrier air travelling through channel 51 can penetrate. Air penetrating through these holes 56 impinges onto the inner side of the walls 59 leading to impingement cooling in addition to the convective cooling of the outer walls 59 in this region.

Within the walls 59 there are provided the vortex generators 23 in a manner such that within the vortex generators cavities 54 are formed which are fluidly connected to the carrier air feed. From this cavity the effusion/film cooling holes 32 are branching off for the cooling of the vortex generators 23. Depending on the exit point of these holes 32 they can be inclined with respect to the plane of the surface at the point of exit in order to allow efficient film cooling effects.

Figure 4:
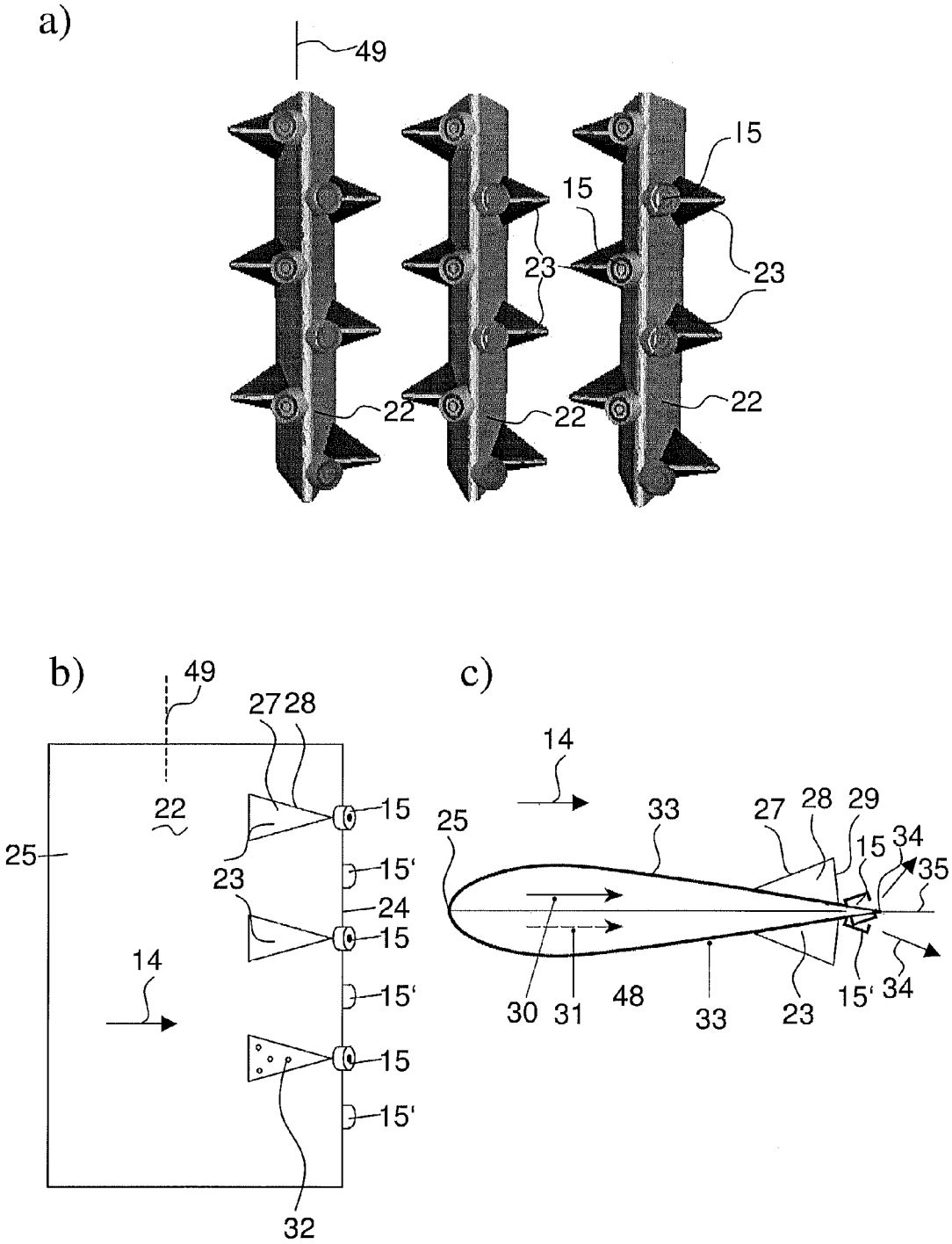
FIG. 4 shows in a) the streamlined body in a view opposite to the direction of the flow of oxidizing medium with fuel injection inclined to the flow of oxidizing medium, in b) a side view onto such a streamlined body, in c) a cut perpendicular to the central plane of the streamlined body.

In an exemplary embodiment of the disclosure shown below in FIG. 4, the fuel is directed at a certain angle (can be increased up to 90°). In this case, the fuel is directed into the vortices which can improve mixing even further.

In the case there are, along the row of nozzles 15, a first set of three nozzles 15, which are directing the fuel jet 34 out of plane 35 at one side of plane 35, and the second set of nozzles 15' directing the corresponding fuel jet out of plane at the other side of plane 35. The more the fuel jets 34 are directed into the vortices the more efficient the mixing takes place.

Figure 5:
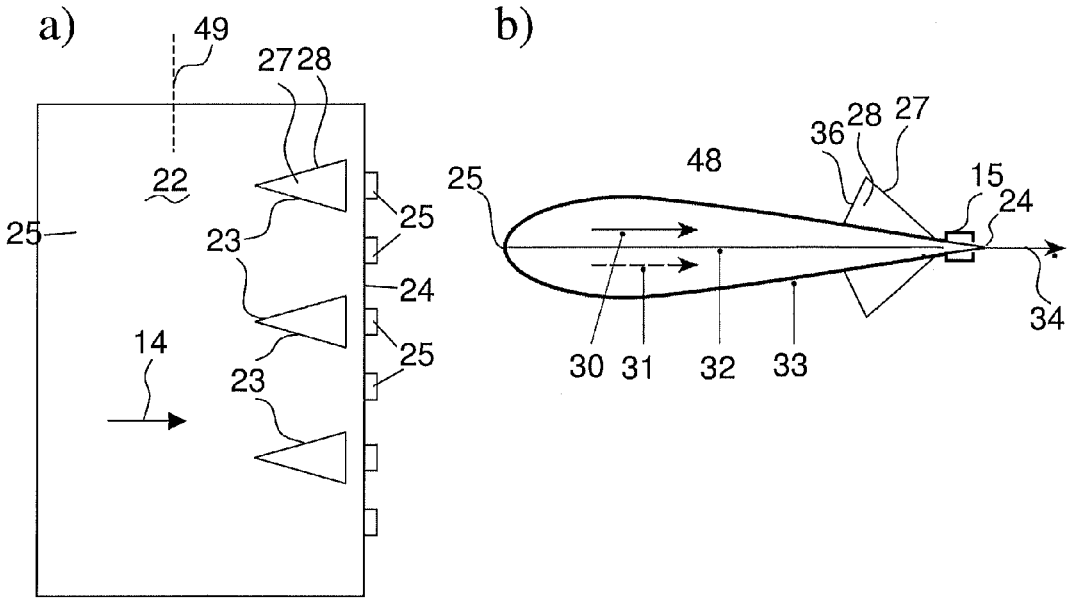
FIG. 5 shows in a) a side view onto a streamlined body with inverted vortex generators, in b) a cut perpendicular to the central plane of the streamlined body.

In another exemplary embodiment of the disclosure, the vortex generators can be inverted (facing upstream) as shown in FIG. 5. This can help in bringing the vortices closer to the fuel injection location without producing adverse flow recirculations. The fuel injection locations can be varied with the vortex generator locations to improve the interaction of vortices with the fuel jet.

In another exemplary embodiment of the disclosure, the inline injection can involve providing 2 fuel jets (injected at an angle) per VG. This can improve the mixing further since each fuel jet is conditioned by the surrounding vortex.

In another exemplary embodiment of the disclosure the number of flutes 22 can be increased to replace the current outlet guide vanes of the high-pressure turbine. This can provide better mixing and arrest adverse flow variations arising from the high-pressure turbine.

In summary, at least the following advantages of the injection concept according to the exemplary embodiments of the disclosure when compared to existing premixed burners can be given:

Inline injection can offer better mixing performance at very low burner pressure drops.

Savings in the burner pressure drop obtained with the proposed inline injection can allow to burn highly reactive fuels and operating conditions. The existing designs pose operational issues for highly reactive fuels.

Inline injection can provide better control of fuel residing close to the burner walls when compared to the cross flow injection concepts. This provides higher flashback margin for the inline injection design.

Reduced burner length resulting in reduction in cooling requirements. Possibility to replace burner effusion cooling air with TBC coated burner.

There is an possibility to mitigate thermo acoustic pulsations due to increased fuel-air mixture asymmetry at the burner exit.

There can be sufficiently high burner velocities in the entire burner length to avoid flame holding due to F/A mixture residing in recirculation regions.

Inline fuel injection with appropriate vortex break down control can ensure appropriate flame stabilization needed for premixed combustion.

Thus, it will be appreciated by those skilled in the art that the present invention can be embodied in other specific forms without departing from the spirit or essential characteristics thereof. The presently disclosed embodiments are therefore considered in all respects to be illustrative and not restricted. The scope of the invention is indicated by the appended claims rather than the foregoing description and all changes that come within the meaning and range and equivalence thereof are intended to be embraced therein.

List of Reference Signs

1 burner
2 mixing space, mixing zone
3 burner wall
4 combustion space
5 outlet side, burner exit
6 inlet side
7 injection device
8 main flow from compressor
11 fuel mass fraction contour at burner exit 5
12 combustion chamber wall
13 transition between 3 and 12
14 flow of oxidizing medium
15 fuel nozzle
18 converging portion of 3
19 reduced burner cross-sectional area
22 streamlined body, flute
23 vortex generator on 22
24 trailing edge of 22
25 leading edge of 22
26 injection direction
27 lateral surface of 23
28 side surface of 23
29 trailing edge of 23
30 fuel gas feed
31 carrier gas feed
32 effusion/film cooling holes
33 lateral surface of 22
34 ejection direction of fuel/carrier gas mixture
35 central plane of 22
36 leading edge of 23
48 cross-sectional profile of 22
49 longitudinal axis of 22
50 central element
51 carrier air channel
52 interspace between 37 and 51
53 distance keeping elements
54 cavity within 23
55 interspace between 51 and 36
56 cooling holes
57 inner fuel tubing, longitudinal part
58 branching off tubing of inner fuel tubing
59 outer wall of 22

What is claimed is:

1. A burner for a single combustion chamber or first combustion chamber of a gas turbine, comprising:

an injection device for introducing at least one gaseous and/or liquid fuel into the burner, wherein the injection device includes, at least one body located in a first section of the burner with a first cross-sectional area at a leading edge of the at least one body with reference to a main flow direction prevailing in the burner arranged in the burner, at least two nozzles for introducing the at least one fuel into the burner, and a mixing zone located downstream of the body with a second cross-sectional area, at and/or downstream of the body, the cross-sectional area is reduced, such that the first cross-sectional area is larger than the second cross-sectional area, wherein the at least two nozzles are arranged at different positions along a trailing edge of the body, wherein upstream of each of these nozzles at least one vortex generator is located.

2. The burner according to claim 1, comprising:

the second cross-sectional area is at least 10% smaller than the first cross-sectional area.

3. The burner according to claim 1, comprising:

the first section of the flow cross-sectional area of the burner is continuously reducing.

4. The burner according to claim 1, wherein the body comprises:

a longitudinal extension substantially along the main flow direction, and wherein the flow cross-sectional area of the burner is continuously reducing from the first cross-sectional area at least over a length of the longitudinal extension.

5. The burner according to claim 1, wherein the injection device injects fuel essentially along the main flow direction or at an angle thereto of less than 90°.

6. The burner according to claim 1, wherein the at least one body is configured as a streamlined body which has a streamlined cross-sectional profile and which extends with a longitudinal direction perpendicularly or at an inclination to a main flow direction prevailing in the burner, the at least one nozzle having its outlet orifice at or in a trailing edge of the streamlined body, wherein the body has two lateral surfaces, and wherein upstream of the at least one nozzle on at least one lateral surface there is located at least one vortex generator.

7. The burner according to claim 6, wherein the vortex generator has an attack angle in the range of 15-20° and/or a sweep angle in the range of 45-75°.

8. The burner according to claim 6, wherein the streamlined body extends across the entire flow cross section between opposite walls of the burner.

9. The burner according to claim 6, wherein the vortex generator comprises:

cooling elements, wherein the cooling elements are film cooling holes provided in at least one of the surfaces of the vortex generator.

10. The burner according to claim 9, the film cooling holes are fed with air from a carrier gas feed also used for the fuel injection.

11. The burner according to claim 1, wherein vortex generators to adjacent nozzles are located at opposite lateral surfaces.

12. The burner according to claim 11, wherein downstream of each vortex generator there are located at least two nozzles.

13. The burner according to claim 11, wherein at least four nozzles are arranged along the trailing edge and the vortex generators are alternatingly located at the two lateral surfaces.

14. The burner according to claim 1, comprising:

at least two bodies, in the form of streamlined bodies arranged in the first section, with their longitudinal axes arranged essentially parallel to each other and with their central planes arranged converging towards the mixing section.

15. The burner as claimed in claim 1, wherein at least one body is a streamlined body, and wherein the profile of the streamlined body is inclined with respect to the main flow direction at least over a certain part of its longitudinal extension.

16. The burner as claimed in claim 15, wherein three streamlined bodies are arranged in the first section.

17. The burner according to claim 1, wherein the body comprises:

cooling elements, wherein the cooling elements are given by internal circulation of a cooling medium along the sidewalls of the body and/or by film cooling holes, located near the trailing edge, and wherein the cooling elements are fed with air from a carrier gas feed also used for the fuel injection.

18. The burner according to claim 1, wherein the fuel is injected from the nozzle together with a carrier gas stream, and wherein the carrier gas air is low pressure air with a pressure in the range of 10-25 bar.

19. The burner as claimed in claim 1, wherein the body is a streamlined body, and wherein the streamlined body has a cross-sectional profile which is mirror symmetric with respect to the central plane of the body.

20. A burner according to claim 1, in combination with a turbine combustion chamber configured for combustion under high reactivity conditions, and/or for the combustion at high burner inlet temperatures and/or for combustion of MBtu fuel.

* * * * *